US009320982B2

(12) United States Patent
Vicentelli

(10) Patent No.: US 9,320,982 B2
(45) Date of Patent: Apr. 26, 2016

(54) MAGNETIC TOY ASSEMBLY

(71) Applicant: Claudio Vicentelli, Alghero (IT)

(72) Inventor: Claudio Vicentelli, Alghero (IT)

( * ) Notice: Subject to any disclaimer, the term of this patent is extended or adjusted under 35 U.S.C. 154(b) by 0 days.

(21) Appl. No.: 14/650,177

(22) PCT Filed: Dec. 11, 2013

(86) PCT No.: PCT/EP2013/076292

§ 371 (c)(1),
(2) Date: Jun. 5, 2015

(87) PCT Pub. No.: WO2014/090906

PCT Pub. Date: Jun. 19, 2014

(65) Prior Publication Data

US 2015/0298021 A1 Oct. 22, 2015

(30) Foreign Application Priority Data

Dec. 12, 2012 (IT) ..... MI12A2118

(51) Int. Cl.
*A63H 33/26* (2006.01)
*A63F 9/08* (2006.01)
(Continued)

(52) U.S. Cl.
CPC ..... *A63H 33/26* (2013.01); *A63F 9/0807* (2013.01); *A63F 9/0838* (2013.01); *A63F 9/0857* (2013.01); *A63F 2009/124* (2013.01); *A63F 2009/1212* (2013.01); *A63H 33/046* (2013.01)

(58) Field of Classification Search
CPC ... A63F 3/00694; A63H 33/046; A63H 33/26
See application file for complete search history.

(56) References Cited

U.S. PATENT DOCUMENTS 3,993,313 A 11/1976 Tillotson
6,158,740 A 12/2000 Hall
(Continued)

FOREIGN PATENT DOCUMENTS

DE 23 46 555 A1 3/1975
(Continued)

OTHER PUBLICATIONS

International Search Report (PCT/ISA/210) mailed on Mar. 12, 2014, by the European Patent Office as the International Searching Authority for International Application No. PCT/EP2013/076292.
Written Opinion (PCT/ISA/237) mailed on Mar. 12, 2014, by the European Patent Office as the International Searching Authority for International Application No. PCT/EP2013/076292. Written Opinion (PCT/ISA/237) mailed on Mar. 12, 2014, by the European Patent Office as the International Searching Authority for International Application No. PCT/EP2013/076292.

*Primary Examiner* — John Ricci
(74) *Attorney, Agent, or Firm* — Buchanan Ingersoll & Rooney PC

(57) ABSTRACT

A magnetic toy assembly suitable for puzzles and playthings includes plural main toy pieces that are magnetically anchorable, in a slidable manner, to a slide surface of a bi-dimensional or three-dimensional base member in magnetically conductive material. Each main toy piece includes: a body made of magnetically non-conductive material, having a rear side surface configured to slidably contact the slide surface of the base member; side contact surfaces configured to allow a contact and a relative sliding movement between the main toy pieces; and at least one magnet at the rear side surface for anchoring the main toy piece to the slide surface of the base member. A number of main toy pieces include a pole extension for the magnetic flux.

10 Claims, 9 Drawing Sheets

(51) Int. Cl.
*A63H 33/04* (2006.01)
*A63F 9/12* (2006.01)

(56) References Cited

U.S. PATENT DOCUMENTS

| | | | |
|---|---|---|---|
| 2002/0135125 | A1 | 9/2002 | Wu |
| 2005/0248090 | A1 | 11/2005 | Anders |

FOREIGN PATENT DOCUMENTS

| | | | |
|---|---|---|---|
| DE | 81 16 935 | U1 | 10/1981 |
| EP | 0 051 576 | A2 | 5/1985 |
| EP | 0 149 326 | A2 | 7/1985 |
| GB | 2 128 104 | A | 4/1984 |
| GB | 2 196 542 | A | 5/1988 |
| GB | 2 459 608 | B | 4/2012 |
| WO | WO 91/03293 | A1 | 3/1991 |
| WO | WO 2006/043840 | A1 | 4/2006 |

MAGNETIC TOY ASSEMBLY

BACKGROUND OF THE INVENTION

The present invention refers to a magnetic toy assembly suitable for forming bi-dimensional and three-dimensional puzzles and/or playthings, and in particular relates to a magnetic toy assembly comprising a plurality of main toy pieces that are magnetically anchorable, in a slidable manner, to a slide surface of an anchorage base member to be moved, placed alongside and positioned amongst one another to make a puzzle and/or a plaything, in which the various toy pieces have improved features from the point of view of magnetic anchorage force and/or the quantity of magnetic material used to provide the anchorage force.

PRIOR ART

Magnetic puzzles or playthings of the type comprising a plurality of main toy pieces, magnetically held together by a bi-dimensional or three-dimensional anchorage base member, are well-known from the prior art.

For example, EP0149326, GB2128104 and GB2196542 show two-dimensional puzzles in which a plurality of single toy pieces are magnetically anchored to a support base, according to a side-by-side arrangement to make up writing, consistent figures or to run challengers or competitions. In general, a puzzle and/or a plaything requires a certain degree of manual dexterity and a certain degree of skill in moving and making up the various toy pieces of the puzzle or plaything, or for solving the game.

Other types of puzzles or playthings are disclosed, for example in U.S. Pat. No. 6,158,740, GB2459608, US2002/135125, WO91/03293 and WO2006/043840.

In particular U.S. Pat. No. 6,158,740 refers to a puzzle game in which a plurality of toy pieces can be assembled in a three-dimensional geometrical shape, for example a spherical shape and are magnetically anchored to a central core.

GB2459608 relates to a three-dimensional puzzle comprising a spherical, or ideal, support member, and a plurality of movable toy pieces, which can be handled at a certain number of axes to make up a great number of configurations.

US 2002/135125 also relates to a composable puzzle, formed by two semispherical bodies, in which a number of variously shaped toy pieces comprise a magnet by means of which the two semispherical support bodies can be assembled.

WO 91/03293 in turn relates to a three-dimensional logic puzzle that is suitable for constructing figures formed of three different groups. The single groups can be rotated around axis of spatial coordinates passing through a central element.

WO 2006/043840 also illustrates a three-dimensional spherical puzzle, in which the various toy pieces comprise a permanent magnet that is polarised radially with respect to central anchoring core around which the various toy pieces can be circumferally slide according to one or more rotation axes.

In most cases in which a magnetic system is used for anchoring the toy pieces to a central ferromagnetic core, or to a metal supporting element, the magnetic flux generated by each magnet flows along an open circuit comprising the same permanent magnet, a central core or a base member made of magnetically conductive material, and long air paths.

Such a solution does not enable the magnetomotive anchorage force H of the magnet to be exploited appropriately, inasmuch as the total air closure of the flux generated by the magnet entails a high reluctance, and a consequent reduction of the magnetic anchorage force; to remedy this drawback, in order to obtain the desired magnetic anchorage force of the single toy pieces, magnets of greater dimensions should be used to compensate for the drop of the magnetomotive force caused by the reluctance of the long air path, with consequent greater magnet costs and greater overall dimensions of the toy pieces.

Another drawback of known magnetic anchorage systems consists of the magnetic repulsion between toy pieces if contiguous pieces of the toy have identical magnetic poles N or S similarly oriented. In fact, if two or more magnets with similarly oriented polarities are placed next to one another, the flux lines that close in air around each magnet interfere with one another, generating repulsion forces that make difficult or do not permit sable reciprocal positioning of the single toy pieces.

Otherwise, if the magnets of two contiguous toy pieces of the toy have a polarity thereof N or S oriented in opposite directions to one another, in this case no repulsion force would arise; nevertheless, the flux of the two magnets would anyway close along an open magnetic circuit, having long air paths, which due to the great reluctance thereof again cause a substantial reduction of the magnetic anchorage force.

OBJECTS OF THE INVENTION

The general object of the present invention is to provide a magnetic toy assembly that is suitable for forming puzzles and/or playthings, of bi-dimensional or three-dimensional type, provided with a magnetic system for the anchorage of the single toy pieces that is suitable for overcoming the drawbacks existing in previously known magnetic anchorage systems.

In particular, one object of the invention is to provide a magnetic toy assembly, as previously mentioned, in which the fluxes of the magnets of the various pieces, during the game, can flow indifferently along one or more closed or open magnetic circuits of series type, as defined below, with consequent sum of the magnetomotive anchorage forces H of the magnets in series in a same circuit, or alternatively circulate along one or more open magnetic circuits, of parallel type, having air paths of comparatively reduced length and such as to have increased magnetic exchange surfaces, with consequent reduction of the intensity of the flux and of the reluctance of the air paths.

In the case of the circuit of series type, the magnetic system is able to exert a magnetic anchorage force both directly between the single toy pieces, and between each toy piece of the toy assembly and an anchorage base member of magnetically conductive material, by means of a simple solution and at a comparatively reduced cost; otherwise, in the case of a circuit of parallel type, the magnetic system is always able to exert a required magnetic force between each toy piece and the anchorage base member, substantially preventing or reducing the occurrence of magnetic repulsion forces between contiguous pieces of the toy, maintaining simultaneously low reluctance of the magnetic circuit and the required magnetic anchorage force.

In all cases a magnetic toy assembly is obtained suitable for forming both bi-dimensional and three-dimensional puzzles or playthings that are extremely versatile and able to permit appropriate magnetic attraction, correct reciprocal positioning and easy sliding of the toy pieces, singularly and/or by groups, according to the type of the toy assembly.

For the purposes of the present description, a "series type" of magnetic circuit is both an "open" and "closed" circuit, in which the magnetic flux circulates along an annular path, comprising at least two side by side arranged toy pieces, in which the permanent magnets of the single pieces are magnetically polarised opposite one another. It is also pointed out that a "series type" circuit is "closed" when the circuit does not have air paths, regardless of the inevitable air gaps between contact surfaces, as a consequence of moulding and/or machining tolerances; whereas a "series type" circuit is said to be "open" when it has short air paths or extends between opposite surfaces of magnetic exchanged, spaced apart from one another, with comparatively low reluctance values, and an orientation of the poles such as to anyway enable a sum of the magnetomotive anchorage forces of the single permanent magnets that belong to a same circuit.

Otherwise, for the purposes of this description, a "parallel type" magnetic circuit is an open magnetic circuit that closes in air directly between the two poles of the magnet, having a comparatively high reluctance value in air compared with a "closed" circuit, and an orientation of the poles or a distance between the polar extensions of contiguous toy pieces, so as to prevent the magnetomotive anchorage forces of the single magnets of two or more side by side arranged toy pieces to sum between themselves; the definitions of the magnetic circuit of open or closed "series" type, or of "parallel" type will again be explained further on with reference to FIGS. 15 to 21.

In the execution of the magnetic toy according to the invention, in moving and combining the various toy pieces together, a "mixed" type of magnetic circuit may occur, comprising at least one "series" magnetic circuit and at least one "parallel" magnetic circuit, as previously defined.

Lastly, still for the purposes of the present description, an "air" path of a "series" or "parallel" type of magnetic circuit is the part of the circuit that does not extend in a magnetically conductive material, for example the part of the circuit comprised between opposite surfaces in magnetic material that are spaced apart from one another.

SHORT DESCRIPTION OF THE INVENTION

These and further objects advantages are obtainable by a magnetic toy assembly according to claim 1; other features of the magnetic toy assembly are defined by the dependent claims.

In particular, according to the invention, a magnetic toy assembly has been provided suitable for puzzles and/or playthings of bi-dimensional and three-dimensional type, comprising:

- an anchorage base member, of magnetically conductive material, having a slide surface for toy pieces;
- a plurality of movable main toy pieces, each comprising a body of magnetically non-conductive material, and at least one permanent magnet, having a polarization axis orientated towards the slide surface, said body of the toy piece having a rear side configured to slidably contact the slide surface of the anchorage base member, and side surfaces configured to allow a contact and a relative sliding movement between the main toy pieces;
- in which the permanent magnet comprises a first pole facing said slide surface, and a second pole facing a direction opposite the first pole of the permanent magnet;
- characterised in that at least two main toy pieces each comprises a pole extension magnetically connected to the second pole of the permanent magnet; and
- in that the pole extension transversely extends to the polarisation axis of the permanent magnet, towards at least one of said side contact surfaces of the toy piece.

All the magnets of the main toy pieces can have the first pole facing the sliding surface of the base member, of a same polarity; alternatively, part of the magnets of the main toy pieces can have the first pole of a same polarity, whilst the magnets of the remaining part of the main toy pieces can have the first pole of a polarity opposite the preceding one.

In an assembled condition of the toy assembly the permanent magnets of at least two or more contiguous toy pieces that have the first pole with a different polarity are magnetically connected in series to one another along at least one magnetic circuit of series type, both closed and open, as previously defined, comprising the permanent magnets, the polar extensions and the slide surface of the anchorage base member; in this manner, a series sum of the magnetomotive forces of the single magnets belonging to a same circuit is provided, to increase the magnetic anchorage force between the toy pieces and towards the slide surface of the anchorage base member of the toy assembly.

Still in an assembled condition of the toy assembly, the permanent magnets of one or more contiguous toy pieces that have the first pole of a same polarity, are singularly connected to one or more magnetic circuits of parallel type, as defined, comprising the permanent magnet and facing magnetic exchange surfaces of the pole extension and of the anchorage base member, in this manner reducing or avoiding the arising of any repulsion or reciprocal influence force between contiguously arranged facing toy pieces.

The base member and the slide surface thereof can have any shape and dimension, for example they can have a flat, arched, semicylindrical, cylindrical, semispherical, spherical shape, and combination thereof, or other suitable shape for a specific toy assembly.

The pole extension of the magnet of every single main toy piece, can have any shape suitable for extending from the second pole of the magnet towards and/or up to one or more side surfaces of the single toy pieces, terminating at a short distance from or at a side contact surface, depending on whether the series circuit is of open or closed type, as defined below.

For the purposes of the present invention, "up to" indicates that the pole extension extends with one or more peripheral edges, terminating at one or more side contact surfaces of the single toy pieces; in this manner physical continuity is obtained of that part of the magnetic circuit in which the flux circulates in a ferromagnetic material between contact edges of polar extensions of toy pieces that are alongside one another; further, the series sum of all the magnetomotive anchorage forces H of the magnets belonging to a same circuit is exploited for reciprocal anchorage between toy pieces and the sliding surface of the anchorage base member.

The expression "towards" indicates that the polar extensions of the magnets of all or part of the toy pieces can extend in the direction of one or more side contact surfaces of the single toy pieces, ending at short distance from or at the same side contact surfaces, where "short distance" is a distance between peripheral edges of two or more polar extensions of toy pieces so as not to create an excessive drop in the magnetomotive forces of the single magnets, thus so as not to create a great magnetic reluctance in the air gaps or paths, which could negatively affects the magnetic anchorage forces; this can be evaluated each time, during the designing of the toy assembly, according to the shape and dimensions of the single toy pieces and of the features of the magnets.

At this point it must be pointed out that the pole extension has to preferably have a thickness that is proportional to the type and dimensions of the magnet, inasmuch as the first aim thereof is to expand the magnetic area of the second pole of the magnet with which it is in contact; simultaneously to this, in the case of a parallel circuit, the aim of the pole extension is to reduce the air gap of the circuit portion comprised between facing surfaces the same pole extension and of the anchorage base member, in the condition in which the magnets of contiguous toy pieces have the first pole facing the slide surface of the anchorage base member, which is of a same or of opposite polarities.

This aim is nevertheless performed in an optimal manner when the surface of the pole extension facing the surface of the anchorage base member is greater than the polar area of the second pole of the magnet, such as to obtain a reduction in the intensity of the magnetic flux in the air path; and when the air path of the circuit has a length that is the same as or less than the length of the magnet. In this manner a reduction of the reluctance and a substantial increase in the efficiency of the magnetic circuit is obtained, with an increase of the anchorage force of the magnet or, for the same magnetic force generated, a corresponding reduction of the quantity of magnetic material.

A second aim of the pole extension in the event the magnets of contiguous toy pieces have the first pole of opposite polarities, consists of creating a circuit that is as closed as possible, of series type as previously defined, so as to enable the magnetomotive forces to be summed. Also this second aim is performed by a general pole extension, but occurs in an optimal manner when the space between the peripheral edges of the pole extension and the corresponding side contact surface of a toy piece is the same as or less than the thickness of the pole extension; in this manner, once again, better efficiency of the magnetic circuit is obtained, with a further increase in performance.

SHORT DESCRIPTION OF THE DRAWINGS

These and further features of the magnetic toy assembly and of the single main toy pieces according to the invention, will be clearer from the following description, with references to the drawings, in which.

The remaining FIGS. 15 to 21 show, comparatively, the various roles played by the pole extension, both in the case of a magnetic circuit of series type, and of parallel type.

DETAILED DESCRIPTION OF THE INVENTION

The general features of the magnetic toy assembly according to the invention will now be disclosed with reference to a bi-dimensional toy assembly shown in the example of FIGS. 1 to 7.

Figure 1:
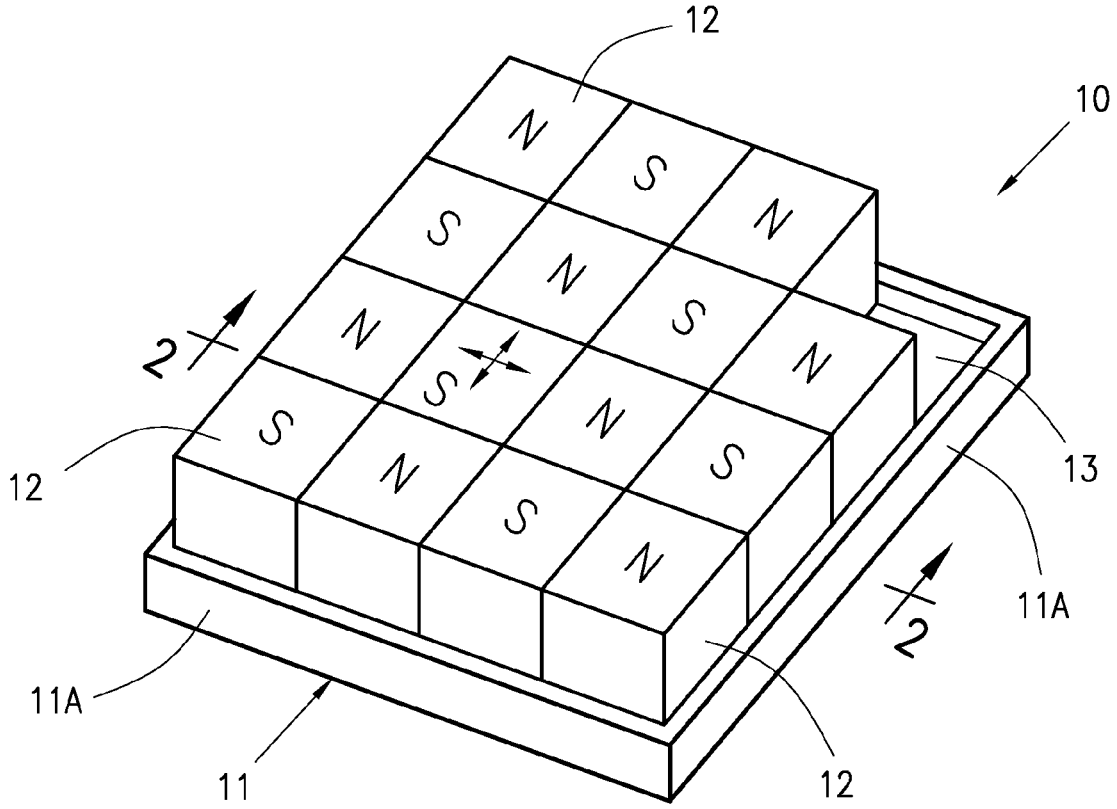
FIG. 1 is a perspective view of a first embodiment of a bi-dimensional magnetic toy assembly according to the invention.
Figure 2:
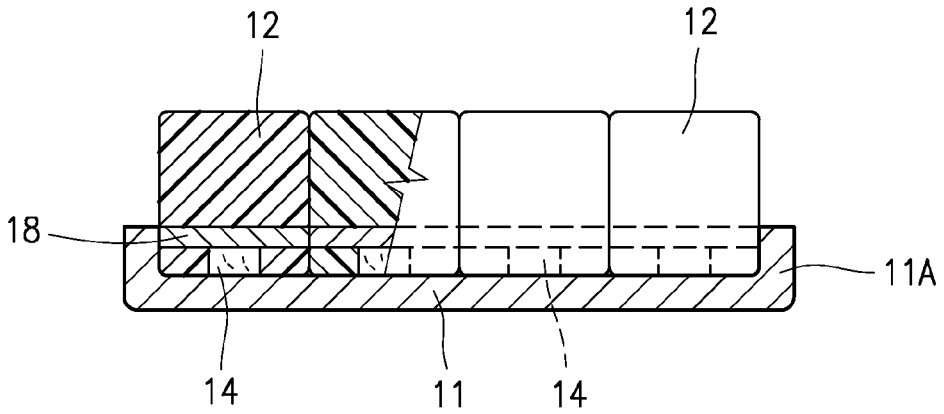
FIG. 2 is a section along line 2-2 of FIG. 1.

As shown in FIG. 1, the toy assembly, indicated overall with 10, is in the shape of a bi-dimensional assembly in which the various main toy pieces that make up the puzzle and/or the plaything can be moved in two orthogonal directions, on a slide plane, as schematically shown.

More precisely, the toy assembly 10 comprises a base member 11 having a planar slide surface 13 and a plurality of main toy pieces 12, which are magnetically anchorable to the slide surface 13 of the base member 11, such that the various toy pieces 12 can be moved singularly and/or by groups, in one or both directions, so as to form a logical sequence or an orderly arrangement of the various toy pieces 12 of the puzzle and/or of the plaything; the slide surface 13 can comprise one or more empty spaces to enable one or more toy pieces 12 to be singularly or conjointly moved.

The shape and/or dimensions of the anchorage base member 11, of the slide surface 13 for the toy pieces 12, and the shape and dimensions of the same toy pieces 12 can be of any type, depending on the type of puzzle and/or of plaything that is intended to be made; FIGS. 1 to 7 show, purely by way of example, a substantially square shape of the anchorage base member 11 and of the slide surface 13 thereof for the main toy pieces 12.

In the example under consideration, the base member 11 and/or the sliding surface 13 for the toy pieces 12 are of magnetically conductive material, such as a sheet of ferromagnetic material; further, the base member 11 has a square shape with side walls 11A for better circulation and closure of the magnetic anchorage fluxes of the toy pieces 12, generated by the magnets 14, as disclosed below.

Figure 3:
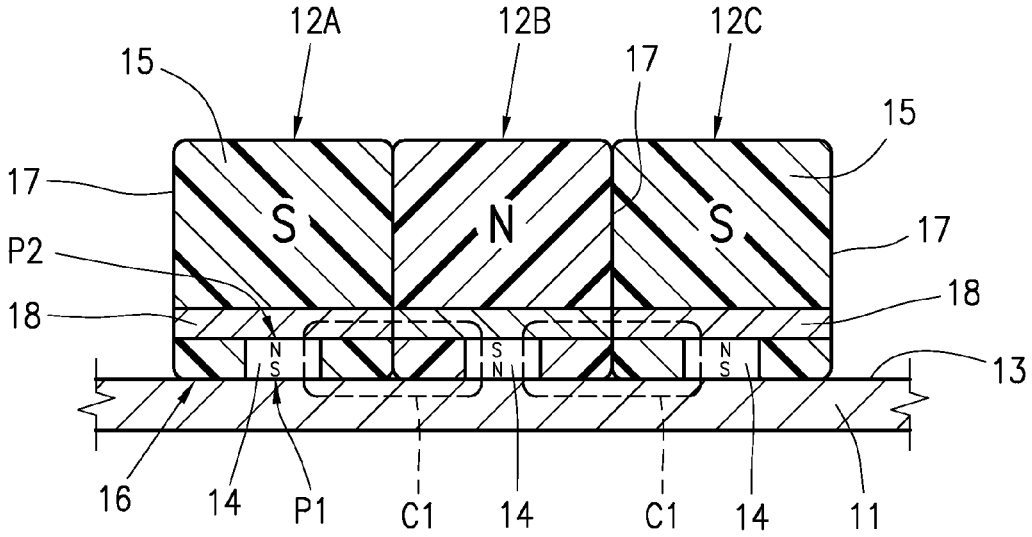
FIG. 3 is an enlarged detail of FIG. 2, showing a first arrangement of three toy pieces of the assembly.

In particular, with reference to FIG. 3 in which three main toy pieces 12 have been schematically illustrated and indicated with 12A, 12B and 12C, each toy piece 12 comprises a body 15 of magnetically non-conductive material, for example plastics, wood, composite material or a combination thereof; the body 15 of each toy piece 12 can have any desired shape, provided that the shape is suitable for enabling a contact and relative sliding movement between single toy pieces, or groups of toy pieces 12 and to enable sliding with respect to the surface 13 of the anchorage base member 11. More precisely, the body 15 of the single toy pieces 12 seen in the direction of the base member 11, comprises a rear side 16 configured for coming into contact, in a slidable manner, with the slide surface 13 of the anchorage base member 11; further comprises side contact surfaces 17 configured for enabling a reciprocal contact and corresponding sliding between the contact surfaces 17 of the various toy pieces 12 that are arranged alongside one another; in the case shown, the side contact surfaces 17 are configured in the form of flat surfaces, nevertheless they could have any other suitable shape, concave and/or convex, in function of the configuration of the anchorage base member 11 and/or of the body 15 of the single main toy pieces 12.

Still with reference to the example in FIG. 3, the various toy pieces 12, on the rear side 16, comprise a permanent magnet 14 that is polarized, in a direction orthogonal to the slide surface 13 of the base member 11; the magnet 14 is axially polarised towards the surface 13, and comprises two poles of opposite polarities (N, S), and in particular a first pole P1 at the rear side facing the slide surface 13 and a second pole P2 facing in an opposite direction to the first pole P1 of the magnet 14.

The first poles P1 of part of the magnets 14 can all be of a same polarity, whereas the first poles P1 of the remaining part of the magnets 14 can be of an opposite polarity in respect to the preceding polarity, as shown in FIG. 1 in which with S and respectively with N are indicated the polarity of the first pole P1 of each magnet 14 which faces the slide surface 13 of the anchorage base member 11.

The various main toy pieces 12, or part thereof, further comprise a pole extension 18 of magnetically conductive material, for example a ferromagnetic sheet, which is magnetically connected to the second pole P2 of a respective magnet 14; the pole extension 18, as shown, transversely extends from the magnet 14, for example orthogonally to the polarisation axis thereof, towards or up to one or more side contact surfaces 17 of the single toy pieces 12, as shown in the various figures; it is again specified that for the purposes of the present description, the expression "up to" is understood to indicate that the pole extension 18 extends from the magnet 14 ending at or at a short distance from one or more side contact surfaces 17 of single toy pieces 12, as defined previously.

The use of the pole extension 18, in part or in all the toy pieces 12 of the toy assembly, for the various roles that it performs, as mentioned previously, constitutes the most characterising feature that is distinguishing the toy pieces 12 and the entire toy assembly, from the toy pieces and toy assemblies previously known, inasmuch as it enables the magnetomotive forces of the magnets to be better exploited providing a better circulation of the magnetic fluxes and the generation of suitable magnetic anchorage forces, avoiding or reducing the occurrence of repulsion magnetic forces between contiguous toy pieces 12 in contact with one another.

Figure 4:
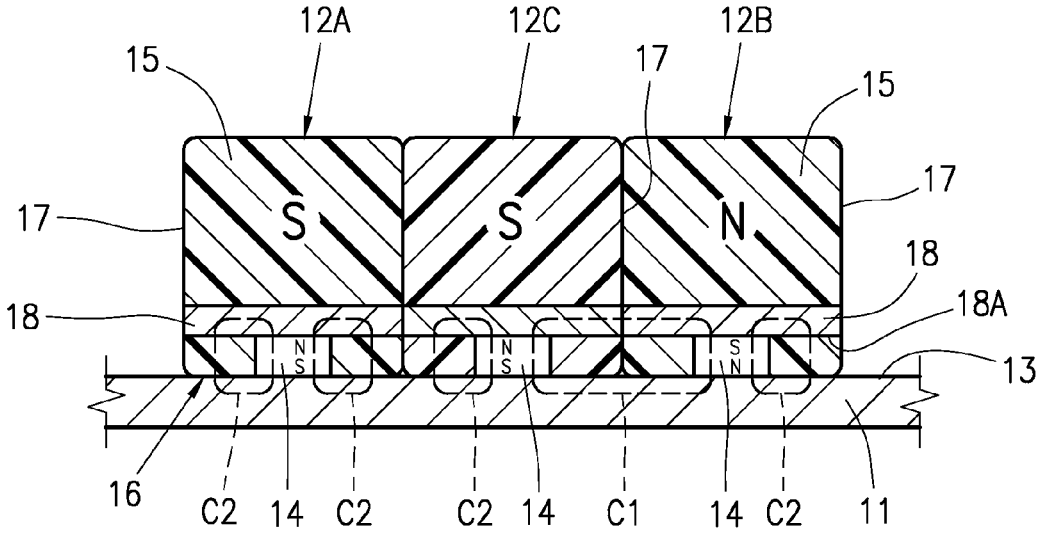
FIG. 4 is an enlarged detail similar to that of FIG. 3, showing a different arrangement of the three toy pieces of the assembly.
Figure 5:
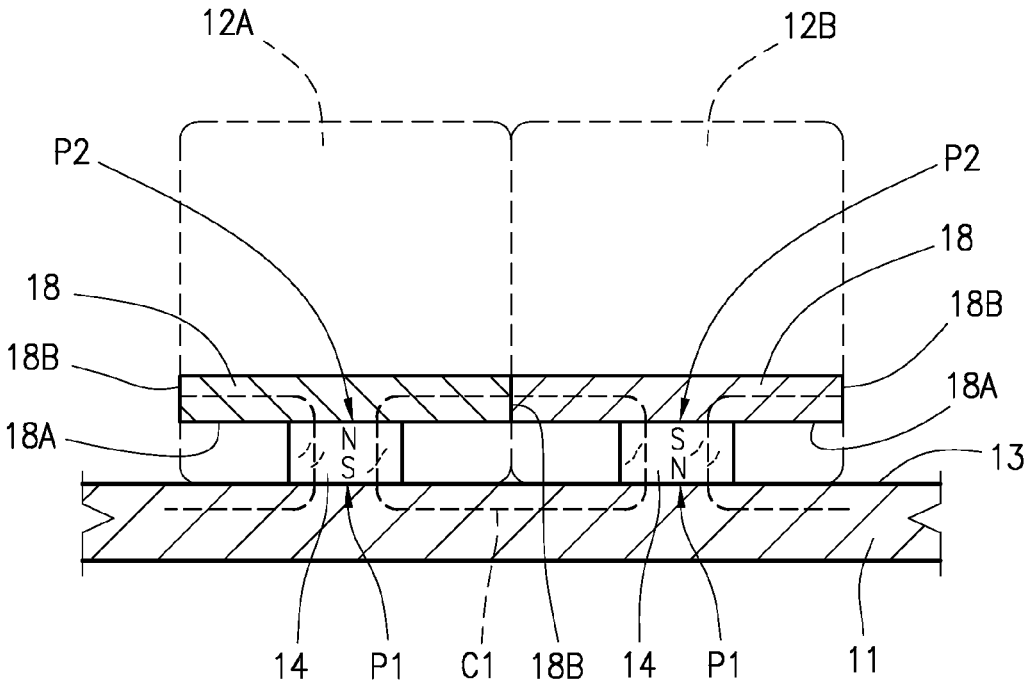
FIG. 5 shows a diagram of a series magnetic circuit of closed type between two toy pieces that are alongside one another.
Figure 6:
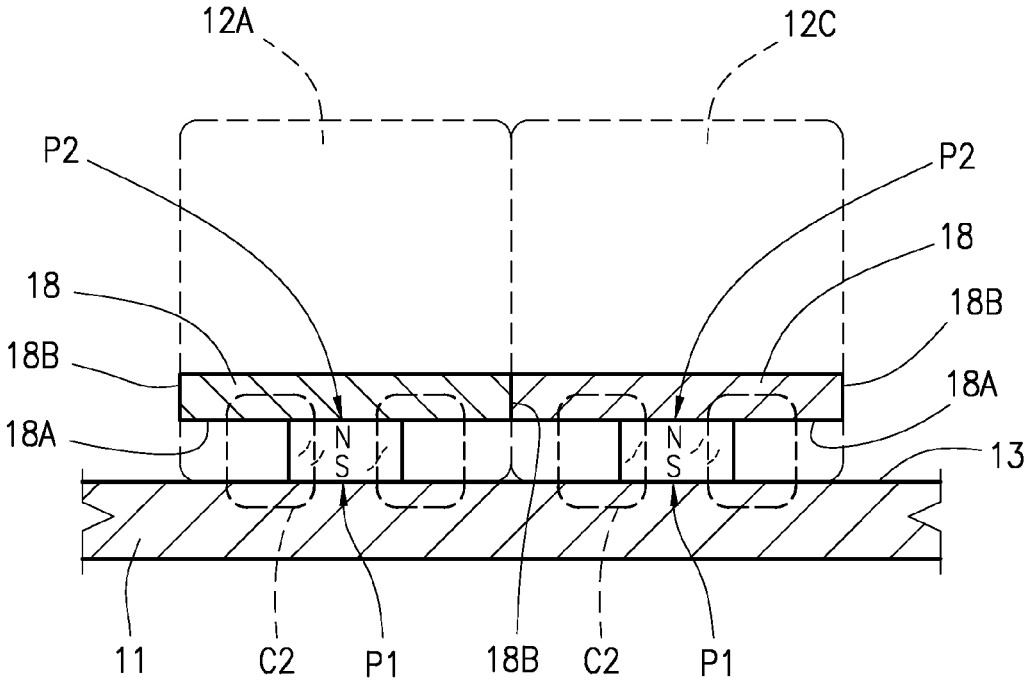
FIG. 6 shows a diagram of a open magnetic circuit of parallel type, between two toy pieces arranged alongside one another.

The above can be explained more clearly with reference, for example, to FIGS. 3 and 4 and to the diagrams of FIGS. 5 and 6. As mentioned previously, in FIG. 3 with 12A, 12B and 12C three main toy pieces 12 are indicated that are in contact with one another, magnetically anchored to the base member 11; the magnets 14 of the two pieces 12A and 12C are polarised in a same direction in which the first magnet pole P1 facing back towards the slide surface 13 of the base member 11 is of the same polarity S, whilst the third toy piece 12B, which is intermediate between the first two, has the magnet 14 polarised in the opposite direction to the preceding directions, with the polarity N of the first pole P1 facing towards the slide surface 13 of the base member 11.

From the example of FIG. 3 it is thus clear that if the permanent magnets 14 of two or more toy pieces 12 placed side by side alongside of the toy assembly 10 have the first pole P1 facing the slide surface 13, of opposite polarities S and N, a series magnetic circuits of closed type C1 is provided, comprising the magnets 14, the polar extensions 18 and the anchorage base member 11. In these assembled conditions of the toy assembly, the magnetomotive anchorage forces of the magnets 14 belonging to a same series magnetic circuit of closed type C1 are summed in series, increasing both the magnetic anchoring force between the polar extensions 18 of the toy pieces 12 in contact with one another, and between each single toy piece 12 and the anchorage base member 11.

During designing the toy assembly, the calculation of the features of the single magnets 14 and of the polar extensions 18 will thus be possible so as to obtain the magnetic forces necessary for a firm anchorage, and to permit sliding of the single toy pieces 12 on the slide surface 13 of the anchorage base member 11 and minimising the dimensions of the toy pieces 12 and the quantity of required magnetic material.

Let it now suppose that during a game the position of the toy pieces 12B and 12C has to be reversed; this condition is represented in FIG. 4, where the same references of FIG. 3 were used to indicate similar or equivalent parts.

In the conditions of FIG. 4, the two toy pieces 12C and 12B, although the position thereof has been reversed with respect to FIG. 3, again define together a series magnetic circuit of closed type C1 as in the preceding case; otherwise, in FIG. 4, between the single toy pieces 12A, 12B and 12C and the base member 11 open magnetic circuits of parallel type C2 are formed, each comprising the magnet 14, the base member 11, the pole extension 18 and the air portion of the flux paths comprised between the facing surfaces 13 of the base member 11 and 18A of the pole extension 18. From FIG. 4 it is thus noted that, although the magnets 14 of the two continuous toy pieces 12A and 12C have the first pole A1 facing the slide surface 13, of the same polarity S, between them there no circulation of the magnetic flux exists in consequence of the low reluctance of the air portion of the flux path, thus no magnetic repulsion force arises between the two toy pieces 12A and 12C that are alongside one another.

These conditions of FIGS. 3 and 4 and the respective series magnetic circuits of closed type C1 and open magnetic circuits of parallel type C2, are illustrated in greater detail in the diagrams of FIGS. 5 and 6, in which the same reference numbers as for FIGS. 3 and 4 have been used to indicate similar or equivalent parts.

Figure 7:
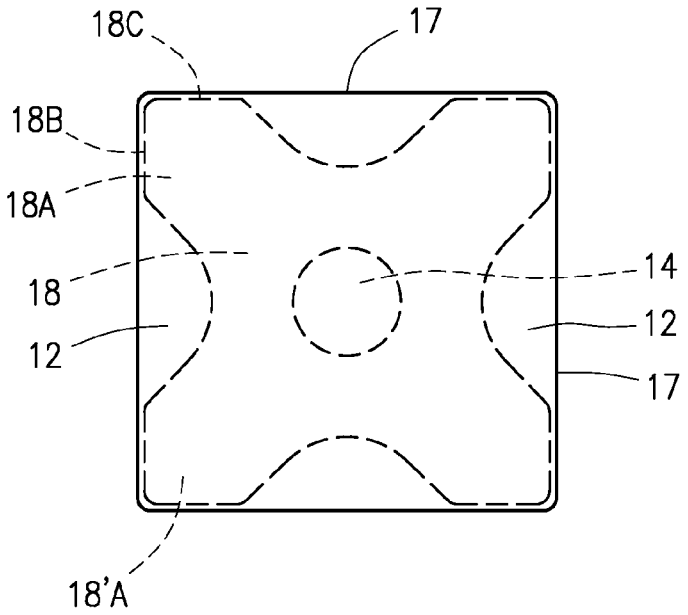
FIG. 7 is a top view of a toy piece of the assembly of FIG. 1 that shows, with dashed lines, the permanent magnet and a specific shape of the pole extension.

FIG. 7 shows a top view of a toy piece of FIG. 1, of square shape, comprising a pole extension 18 differently shaped compared with the body of the piece 12; again in FIG. 7 the same reference numbers have been used as for the preceding figures to indicate similar or equivalent parts.

The toy piece 12 of FIG. 7 comprises a body 15 of square shape, delimited by flat side contact surfaces 17; the toy piece 12 further comprises a central magnet 14, for example of cylindrical shape, in which a star-shaped pole extension 18 transversely extends; the pole extension 18 is configured with four arms 18A radially directed from the magnet 14 to the four corners of the body 15.

Each arm 18A terminates, at the end thereof, with two edges 18B and 18C, oriented at 90°, that conform to the flat side contact surfaces 17 of the body 15; in this manner, on each side contact surface 17 of the body 15, or. at each angle, two anchorage magnetic zones are obtained between toy pieces 12, in which the magnetic fluxes are more concentrated and, consequently, the magnetic anchorage forces between the toy pieces 12; naturally, the shape and dimensions of the pole extension 18 can be any, depending on the specific needs of every single toy piece 12, not being strictly constrained by the shape and dimensions of the same main toy pieces 12 of the assembly according to the present invention.

FIGS. 1 to 7 refer to a magnetic toy assembly for a puzzle and/or a plaything of bi-dimensional type; the general features of the magnetic toy assembly 10 and of the single toy pieces 12 according to the present invention remaining the same, it is possible to make a puzzle and/or a plaything of three-dimensional type.

Figure 8:
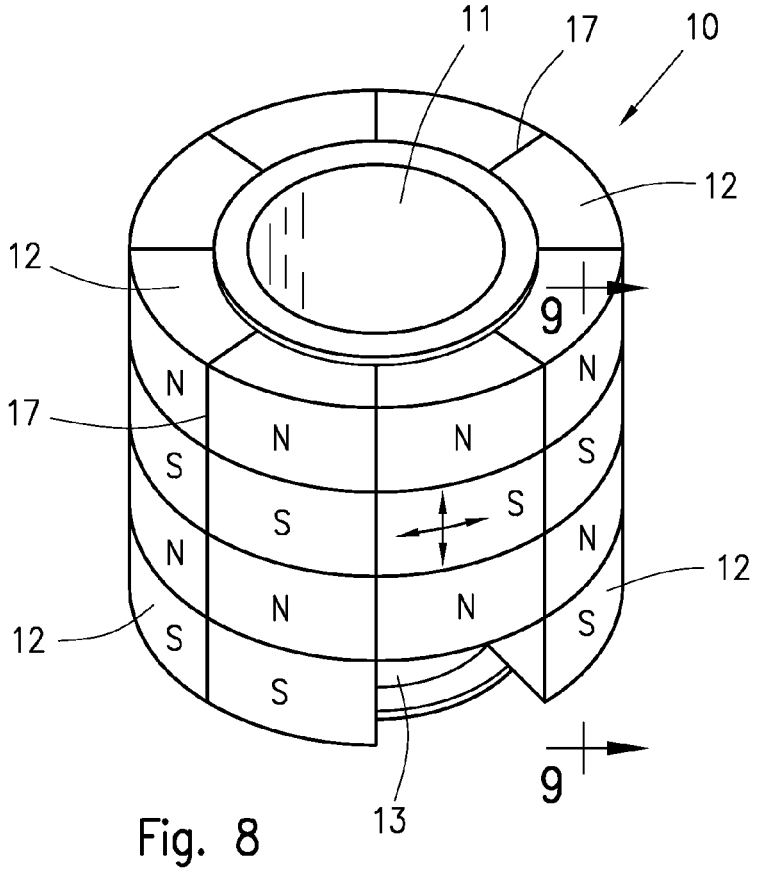
FIG. 8 is a perspective view of a second three-dimensional embodiment of a cylindrical toy assembly.
Figure 9:
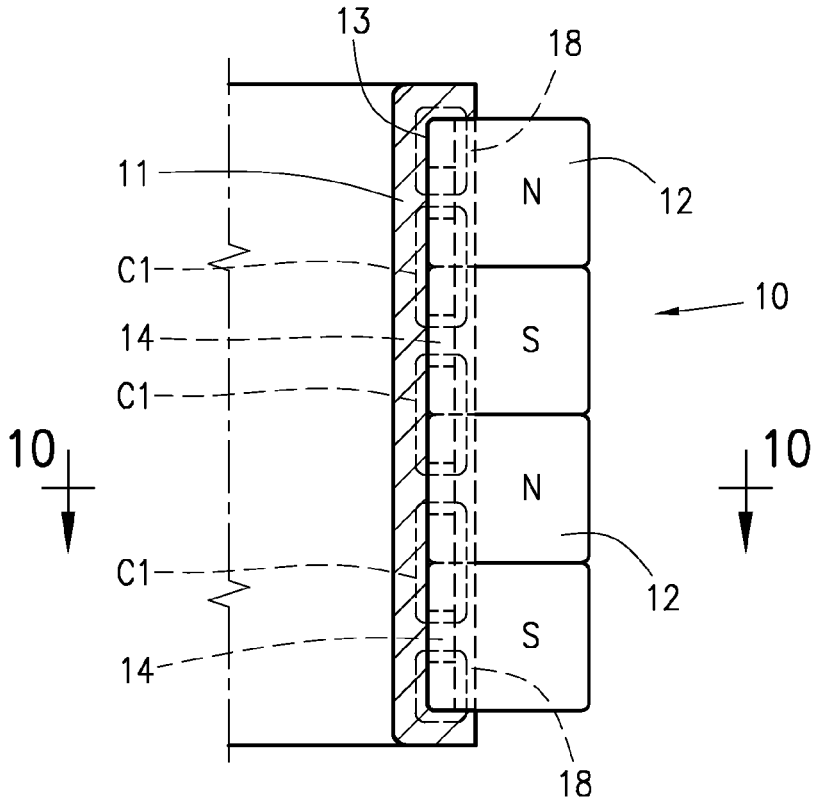
FIG. 9 is a longitudinal section according to the line 9-9 of FIG. 8.
Figure 10:
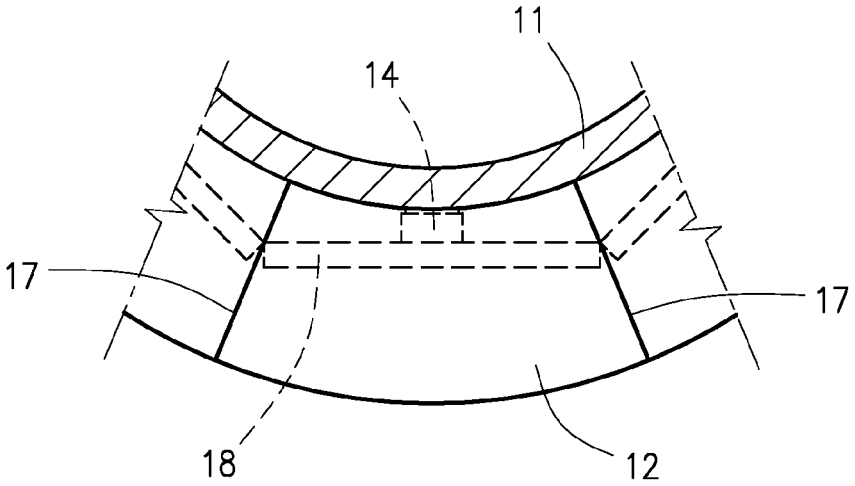
FIG. 10 is a cross section of a toy piece, according to the line 10-10 of FIG. 9.

FIGS. 8, 9 and 10 refer to a magnetic toy assembly 10 of cylindrical shape; again in these figures the same reference numbers have been used as for the preceding figures to indicate similar or equivalent parts.

In the case under consideration, the anchorage base member 11 has the shape of a spool or a tubular element of magnetically conductive material, having a cylindrical external surface 13 for the magnetic anchorage and the sliding of the main toy pieces 12, which can be moved singularly and/or in groups in the two orthogonal directions, i.e. circumferally and/or axially to the same tubular base member 11.

Also in this case, as shown in FIGS. 9 and 10, the single toy pieces 12 have the same magnetic and general structural features as the preceding example, with the difference that they now have radially directed side contact surfaces 17, on planes converging towards the longitudinal axis of the tubular base member 11; the single toy pieces 12 also differ from the preceding ones, inasmuch as the rear side, facing the slide surface 13, now is arched shape to conform to the external cylindrical contact surface of the tubular base member 11.

Also in this case, as in the preceding case, the toy assembly 10 could be devoid of at least one toy piece 12, or of an entire row, both in a longitudinal and a circumferal direction to enable the single toy pieces 12, or a group of toy pieces 12 to be moved and slide during the game.

Alternatively to the cylindrical shape of the base member 11 of the toy assembly of FIG. 8 other embodiments are possible, for example a three-dimensional, semicylindrical, semispherical, spherical shape or a combination thereof; the same toy pieces 12 could have a different shape from the one shown, for example have a cylindrical, conical, pyramid or other shape, provided that it is suitable for providing one or more side contact surfaces.

Figure 11:
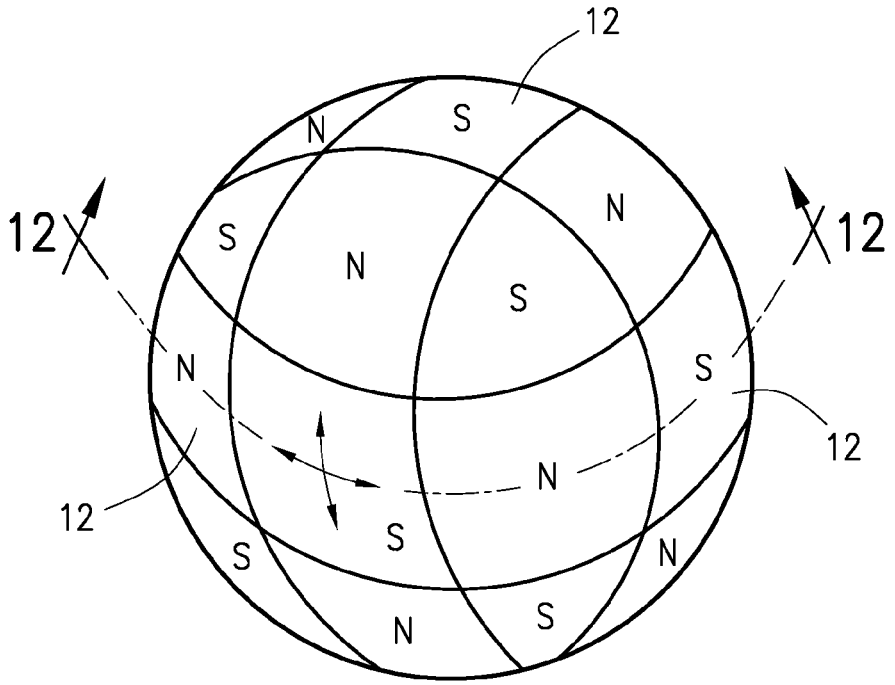
FIG. 11 is a perspective view of a third three-dimensional embodiment of a spherical toy assembly.
Figure 12:
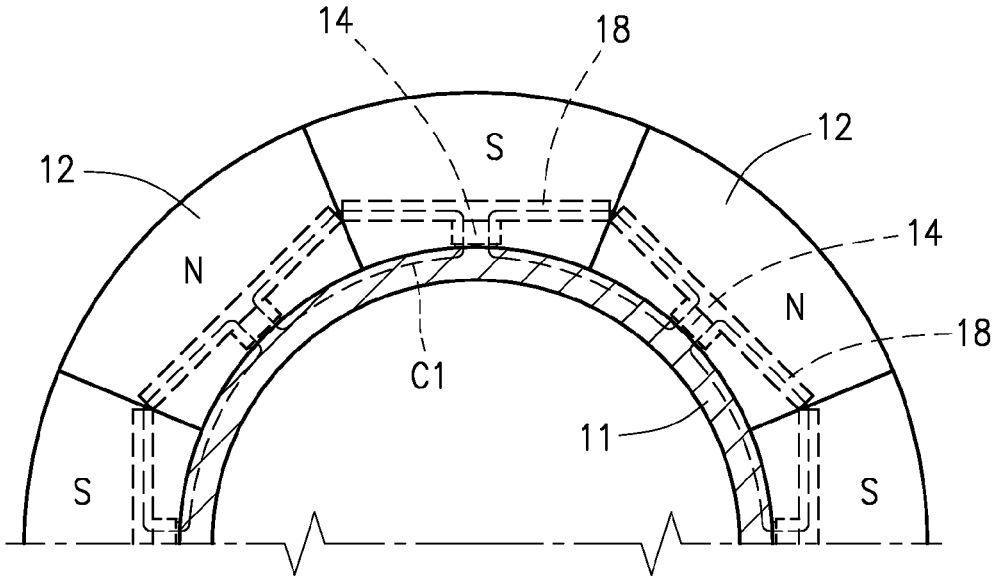
FIG. 12 is a cross section according to the line 12-12 of FIG. 11.

FIGS. 11 and 12 again show, by way of example, a toy assembly of spherical shape and an enlarged cross section thereof, according to the line 12-12 of FIG. 11; again in FIGS. 11 and 12 the same reference numbers as for the preceding examples have been used to indicate similar or equivalent parts.

Regardless of the spherical shape, the single main toy pieces 12 have the same general magnetic features as the preceding toy pieces, i.e. they comprise a magnet 14 polarised in the axial direction, and a pole extension 18 magnetically connected to the second pole P2 of the magnet 14, which always extends transversely or orthogonally to the polarisation axis of the magnet 14. In this case, unlike the preceding cases, part of the toy pieces 12 have concave and/or arched shape side contact surfaces of, that tape towards the centre of the spherical surface, and extend along circumferal strips, to be moved and rotated in two orthogonal directions again indicated by the double arrow in FIG. 11. Whereas in the preceding cases all the toy pieces 12 of the toy assembly 10 had the same shape, in the case of the sphere of FIG. 11, viewed frontally, there are toy pieces 12 having four side contact surfaces and a toy piece having three side contact surfaces conforming to the preceding ones.

In the examples in the FIGS. 1-12 some magnetic toy assemblies have been disclosed in which the single main toy pieces 12 comprise flat or arch shaped contact side surfaces; as already mentioned, in the context of the present invention it is possible to provide a different shape of the single toy pieces 12, for example a cylindrical, conical or prismatic shape, provided that it is suitable for allowing a magnetic contact between the various toy pieces 12, both between them and with the slide surface 13 of the anchorage base member 11.

Figure 13:
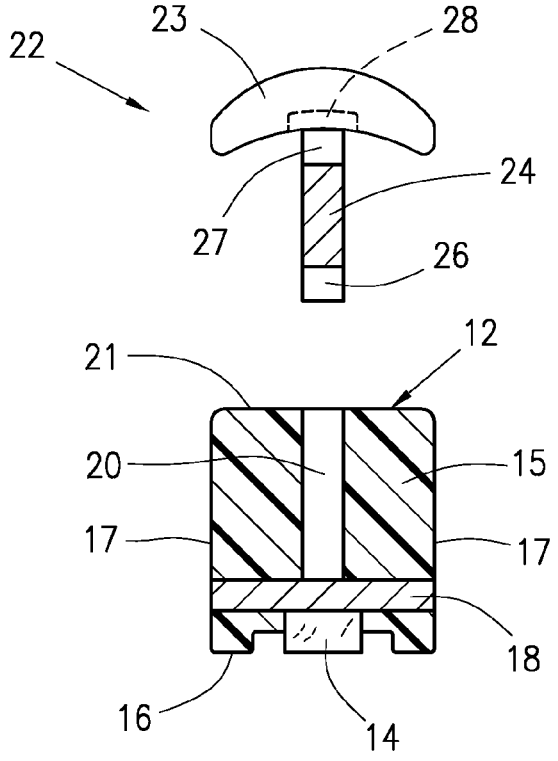
FIG. 13 is an exploded section of a main toy piece and of an additional toy piece that are magnetically anchorable.
Figure 14:
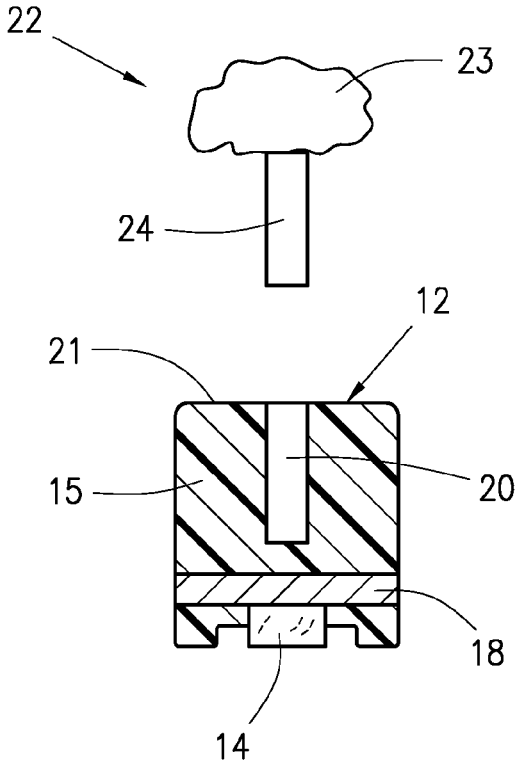
FIG. 14 is an expanded section of a main toy piece and of a mechanically anchorable additional toy piece.

FIGS. 13 and 14 show further features of the main toy pieces 12, which can be used in combination with further additional toy pieces suitable, for example, for changing the outer appearance, or for creating new and different compositions; again in these figures the same reference numbers as in the preceding figures have been used to indicate similar or equivalent parts.

The solution of FIG. 13, regardless of the specific shape of the single toy piece 12, differs inasmuch as the body 15 is provided with at least one bore 20 that extends from an external or peripheral surface 21 to the pole extension 18. The toy assembly further comprises one or more supplementary pieces 22 each comprising a cylindrical shank 24 that is suitable for being fitted into the through bore 20 and for being magnetically anchored to the pole extension 18 of the toy piece 12, by a first magnet 26 at the fore end of the shank 24.

In the case shown in FIG. 13, the additional piece 22 comprises, for example, a mushroom-shaped head 23 and the shank 24 suitable for being fitted into the bore 20 of the body 15. The shank 24 can be integral with the head 23 of the mushroom, or can comprise a second magnet 27 at the rear end thereof magnetically connectable to a metal inert 28 of the head, or vice versa.

FIG. 14 shows an alternative solution in which the additional toy piece 22 is mechanically fixed to the toy piece 12 of the assembly; in the case of FIG. 14 the same reference numbers as for FIG. 13 have again been used to indicate similar or equivalent parts. In the case of FIG. 14 the supplementary toy piece 22 comprises again a head 23 and a shank 24; in this case the shank 24 is press-fitted in a disengageable manner, into a dead bore 20 of the toy piece 12; in place of the press-fitting connection, any type of mechanical connection can be provided between the supplementary toy piece 22 and the main toy piece 12 of the disclosed toy assembly.

With reference to FIGS. 15 to 21, the functions of the polar extensions 18 of the single toy pieces 12 will be more fully clarified, in the various shapes and solutions, regardless of the shape and dimensions of the body 15 and of the toy pieces 12; thus in the various FIGS. 15 to 21 the same reference numbers of the preceding figures have been used, to indicate similar or equivalent parts. For greater clarity, the example of FIGS. 16-19 according to the present invention, in the various functions thereof, are compared with a conventional toy piece shown in FIG. 15.

Figure 15:
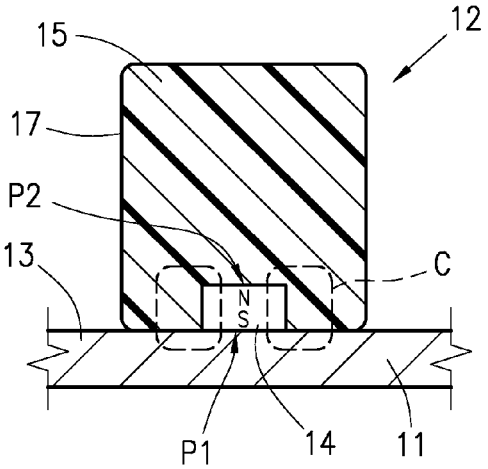

As shown in FIG. 15, in a toy piece 12 of conventional type, the magnet 14 is devoid of any pole extension; thus the flux lines C close totally in air between the two poles P1 and P2 in an open magnetic circuit characterised by high magnetic reluctance that generates a great drop of the magnetomotive force H of the magnet 14.

Otherwise, FIGS. 16, 17, 18 and 19 show different solutions and shapes of the pole extension 18, and the magnetic fluxes generated.

Figure 16:
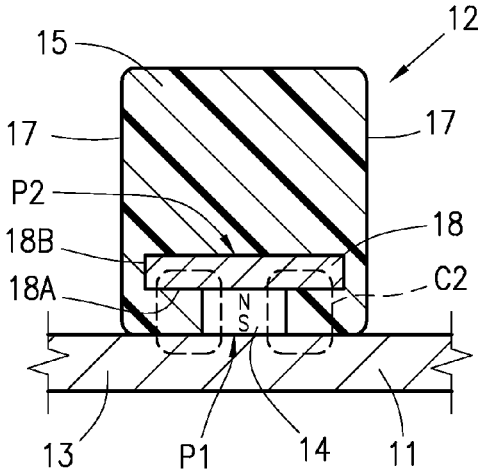

In particular, FIG. 16 shows that the pole extension 18 has greater dimensions than the polar area of the magnet 14, extending to one or more side contact surfaces 17 of the toy piece 12, ending at a certain distance, which varies from case to case, from the side contact surfaces of the toy piece 12.

In this solution an open circuit of parallel type is formed, as defined previously, in which the magnetic flux in aria is distributed on two facing surfaces 18A of the pole extension 18, and 13 of the anchorage base member 11; in this manner both the air path and the density of the flux in the same air path is substantially reduced, with a consequent reduction of the reluctance and an increase of the magnetic anchorage force. Further, as the totality of the magnetic flux of C2 flows between the two facing surfaces 18A and 13, without affecting the peripheral surface 18B of the pole extension, when two toy pieces 12 having similarly oriented poles P1 and P2 of the magnets 14, are placed alongside one another, magnetic repulsion forces or negative influences between magnets do not occur.

Figure 17:
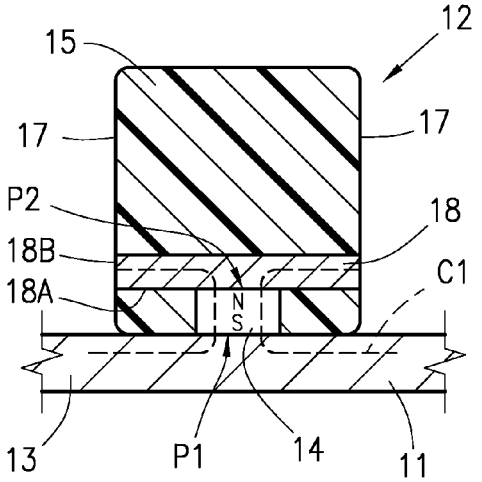

FIG. 17 shows a second solution in which la pole extension 18 extends over the entire width of the toy piece 12, ending with the edge or peripheral surface 18B thereof at one or more side contact surfaces 17 of the toy piece 12, flush to the contact surfaces. This solution of FIG. 17 is particularly advantageous for forming closed magnetic circuits C1 of series type between contiguous toy pieces, for example as shown in FIG. 3, or mixed magnetic circuits consisting of the circuits C1 and C2, as shown in FIG. 4.

Figure 18:
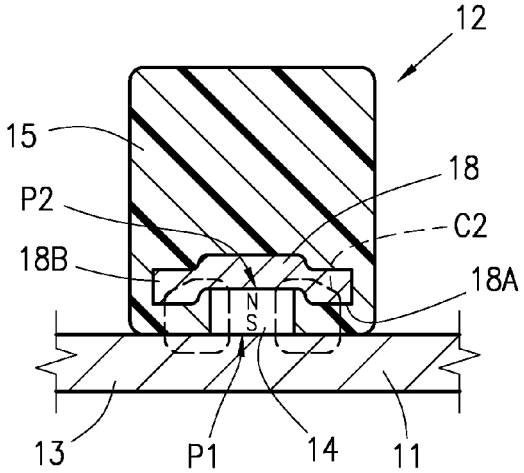

FIG. 18 shows a further possible solution for the pole extension 18, that is distinguishing from that of FIG. 16 inasmuch as now the pole extension 18 has now been suitably shaped along the peripheral edge, so as to bring the surface 18A thereof nearer the slide surface 13 of the anchorage base member 11; by shortening the distance between the two facing surfaces 18A and 13, compared with FIG. 16, further reduces the reluctance in air for the magnetic flux, with a consequent further increasing of the magnetic anchorage force.

Figure 19:
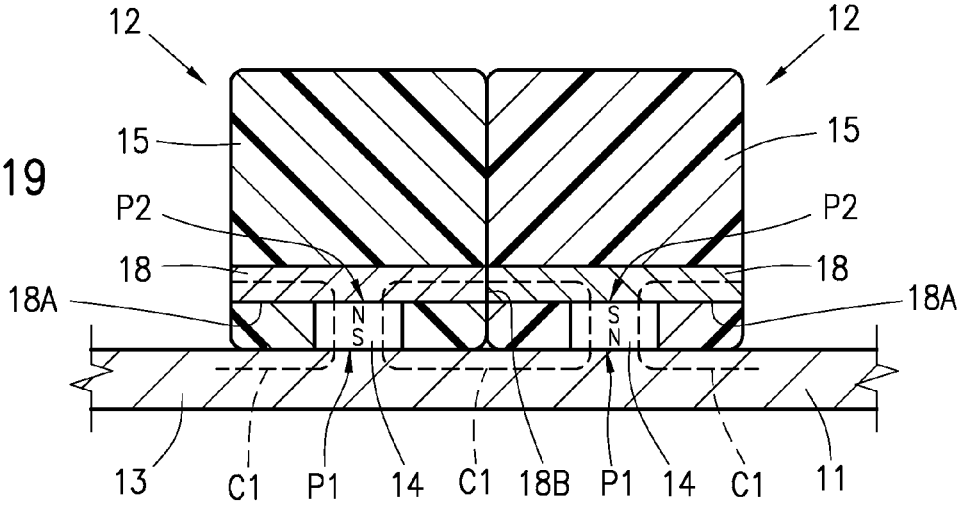
Figure 20:
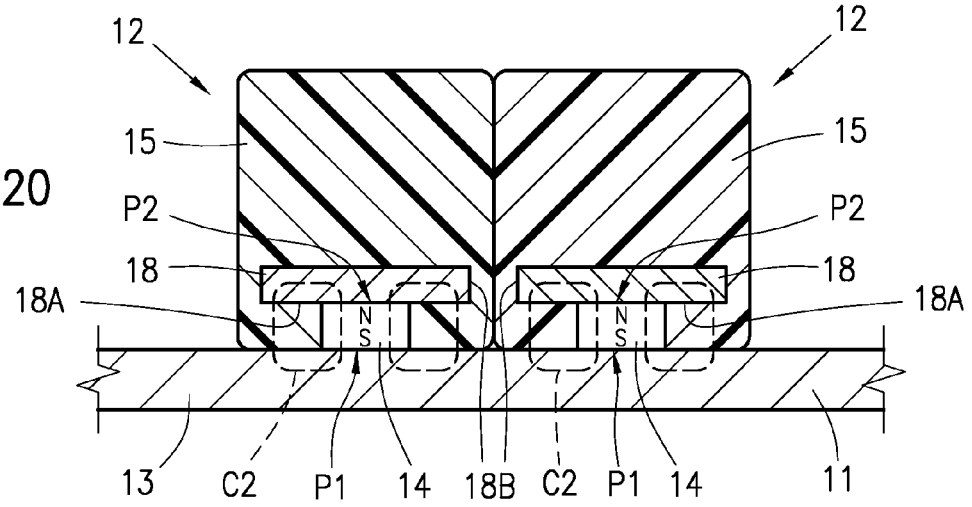
Figure 21:
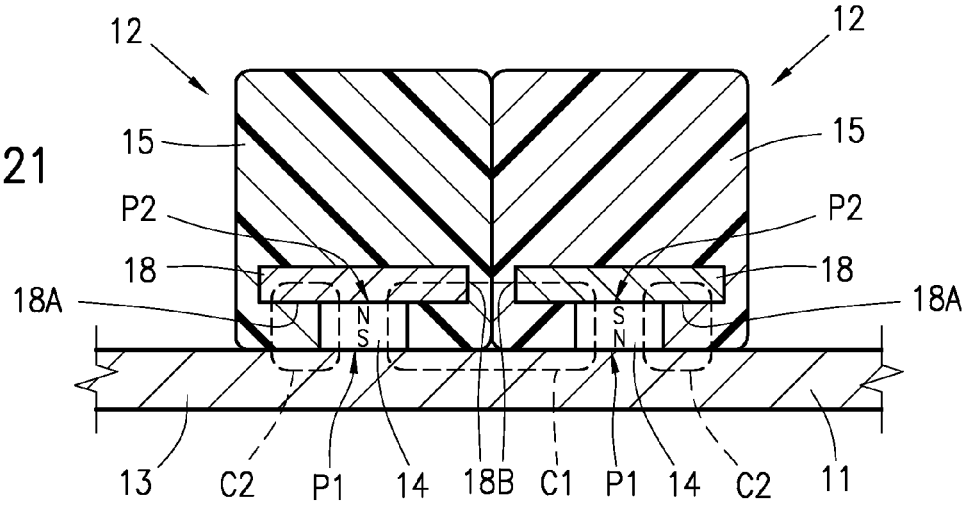

Lastly, FIGS. 19 to 21 show, schematically, some possible magnetic circuits that can occur during a game, between two or more toy pieces 12 positioned alongside one another; again the same reference numbers of the preceding figures have been used, to indicate similar or equivalent parts.

In particular FIG. 19, in which the peripheral edges 18B of the two polar extensions 18 are directly in contact with one another, shows the formation of closed magnetic circuits C1, of series type, in which a physical continuity of the flux path exists, i.e. devoid of air gaps, comprising the polar extensions 18, the magnets 14 and the base member 11 in ferromagnetic material.

FIG. 20 on the other hand shows the formation of open magnetic circuits C2, of parallel type, if the magnets 14 are polarised in the same direction, i.e. have the poles P1 of the same polarity N or S oriented towards the slide surface 13 of the anchorage base member 11.

Otherwise, FIG. 21 shows the case in which mixed open magnetic circuits C1 of series type and mixed open magnetic circuits C2 of parallel type are formed between toy pieces positioned alongside one another if the magnets 14 have their first poles P1 of opposite polarity, as shown.

From what has been said and shown with reference to the examples of the enclosed drawings, it will have been understood that the invention is directed to a magnetic toy assembly having the general features disclosed, suitable for forming puzzles and/or playthings, in which the movable toy elements of the assembly have improved magnetic anchorage features to a support base member, the geometric configuration and dimensions of which can be of any type. It is nevertheless understood that what has been said and shown has been proved merely by way of example and that other modifications or variants, both in the shape and in the dimensions, can be provided for the entire assembly and/or the various main and/or additional toy pieces of the toy, without thereby departing from the claims.

The invention claimed is:

1. A magnetic toy assembly, suitable for bi-dimensional and three-dimensional puzzles and/or playthings, comprising:

an anchorage base member in magnetically conductive material, having a slide surface for toy pieces;

a plurality of movable main toy pieces, each having a body in magnetically non-conductive material and at least one permanent magnet, having a polarization axis orientated towards the slide surface; said body having a rear side configured to slidably contact the slide surface of the anchorage base member, and side contact surfaces configured to allow a contact and a relative sliding movement between the main toy pieces;

in which the permanent magnet includes a first pole (P1) facing said slide surface, and a second pole (P2) facing in an opposite direction in respect to the first pole (P1) of the permanent magnet;

wherein each of two or more main toy pieces includes a pole extension magnetically connected to the second pole of the permanent magnet; and wherein the pole extension extends crosswise the polarization axis of the permanent magnet, towards at least one side contact surface of the body of the main toy piece.

2. The magnetic toy assembly according to claim 1, wherein the pole extension extends from the second pole of the permanent magnet, up to at least one of said side contact surfaces, or for at least part of the body located between the second pole of the permanent magnet and a side contact surface of the main toy piece.

3. The magnetic toy assembly according to claim 1, wherein the permanent magnets of the main toy pieces comprise:

a first pole of a same polarity, facing the slide surface of the anchorage base member.

4. The magnetic toy assembly according to claim 1, wherein the permanent magnets of a first set of the main toy pieces have a first pole of a same polarity, while the permanent magnets of a second set of the main toy pieces have the first pole of a polarity opposite to a previous one, facing the slide surface of the anchorage base member.

5. The magnetic toy assembly according to claim 4, wherein, in an assembled condition of the main toy pieces, the permanent magnets of at least two side by side arranged main toy pieces having the first pole of opposite polarity, are magnetically connected in a closed, or open, magnetic circuit of series type, containing the permanent magnets, respective pole extensions, the anchorage base member and air paths or air gaps.

6. The magnetic toy assembly according to claim 4, wherein, in an assembled condition of the main toy pieces, the permanent magnets of at least two side by side arranged main toy pieces having the first pole of a same or opposite polarities, are arranged in a magnetic circuit of parallel type, containing the permanent magnet, the pole extension, the anchorage base member and at least an air path or gap located between facing surfaces of the extension pole and of the anchorage base member.

7. The magnetic toy assembly according to claim 1, wherein the slide surface of the anchorage base member of the main toy pieces, comprises:

a bi-dimensional planar slide surface, or a three-dimensional slide surface selected from: arch-shaped, semi-cylindrical, cylindrical, semi-spherical, spherical, or their combination.

8. The magnetic toy assembly according to claim 1, wherein the body of one or more of the main toy pieces comprises:

at least a bore extending from a peripheral surface towards the pole extension; and at least one additional toy piece having an elongated anchorage member configured to be removably engaged into said bore.

9. The magnetic toy assembly according to claim 8, wherein said bore and said elongated anchorage member are configured for press-fitting or mechanical anchorage to a main toy piece of the toy assembly.

10. The magnetic toy assembly according to claim 8, wherein said bore extends to the pole extension, and said elongated anchorage member comprises: a magnet member for anchorage to the pole extension of a main toy piece.

* * * * *